US005116014A

United States Patent [19]

Slavens et al.

[11] Patent Number: 5,116,014

[45] Date of Patent: May 26, 1992

[54] BEACH TOWEL ANCHOR

[76] Inventors: Samuel T. Slavens; Carolina G. Slavens, both of 5115 E. 86th St. N., Owasso, Okla. 74055

[21] Appl. No.: 714,631

[22] Filed: Jun. 13, 1991

[51] Int. Cl.[5] ..... A47B 97/00

[52] U.S. Cl. ..... 248/500; 16/1 R

[58] Field of Search ..... 248/500, 504, 910, 510; 24/570, 571; 16/1 R; D6/608

[56] References Cited

U.S. PATENT DOCUMENTS

| | | | |
|---|---|---|---|
| 509,900 | 12/1893 | Heysinger | 16/1 X |
| 525,677 | 9/1894 | Collins | 16/1 X |
| 550,274 | 11/1895 | Johnson | 24/570 X |
| 581,868 | 5/1897 | Mullane | 24/570 X |
| 1,843,692 | 2/1932 | McDonald | 16/1 X |
| 2,600,091 | 6/1952 | Becker | 24/571 |

FOREIGN PATENT DOCUMENTS

| | | | |
|---|---|---|---|
| 108883 | 2/1928 | Austria | 16/1 |

*Primary Examiner*—J. Franklin Foss
*Attorney, Agent, or Firm*—Leon Gilden

[57] ABSTRACT

An anchor structure includes a unitary housing formed with a planar top surface and a partial planar bottom surface, with an arcuate projection defining a forward portion of the bottom surface for enhanced positioning within a sand surface, wherein the organization includes a tongue member resiliently biased within a through-extending anchor bore directed through a rear portion of the top and bottom surfaces, with a forward portion of the bottom surface of the anchor member in biased communication with the top surface to secure a towel portion within the bore under the tongue. A modification of the invention includes bag structure mounted to the top surface for permitting filling of the bag structure with a weighted material, such as beach sand, to enhance tethering of an associated towel member to the beach surface.

2 Claims, 4 Drawing Sheets

BEACH TOWEL ANCHOR

BACKGROUND OF THE INVENTION

1. Field of the Invention

The field of invention relates to beach accessory apparatus, and more particularly pertains to a new and improved beach towel anchor wherein the same is arranged for maintaining a beach towel on a sand surface of a beach and the like.

2. Description of the Prior Art

Anchoring devices have been utilized in the prior art for maintaining a beach towel, blanket, and other similar articles on the sand of a beach surface. This is particularly a problem as sea breezes and the like, as well as movement of an individual upon an associated beach towel, effects displacement of the beach towel relative to the sand. Prior art devices utilized to maintain a beach towel in position on a sand surface are exemplified in U.S. Pat. No. 4,927,118 to Pierorazio wherein a beach accessory device utilizes a manner of projecting the device into a sand surface, as well as providing a receptacle for retaining various articles therewithin, such as keys and the like.

U.S. Pat. No. 4,272,575 to Egigian sets forth an anchor mat wherein an edge portion of an associated mat member is formed as a semi-cylindrical tube to scoop under the sand permitting anchoring of the beach towel thereto.

U.S. Pat. No. 4,682,447 to Osborn sets forth a tarpaulin structure utilizing grommets that are weighted for maintaining the flexible webbing to a support surface.

U.S. Pat. No. 3,935,653 to Klein and U.S. Pat. No. 4,699,165 to Barazana are further examples of stake type devices arranged for projection into the sand for securing a portion of a beach blanket to each device to retain the beach blanket structure in position.

As such, it may be appreciated that there continues to be a need for a new and improved beach towel anchor as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of beach accessory devices now present in the prior art, the present invention provides a beach towel anchor wherein the same utilizes a clip member cooperating with a central bore to position and retain a beach blanket to a sand support surface. As such, the general purpose of the present invention, which will be described subsequently in greater detail, is to provide a new and improved beach towel anchor which has all the advantages of the prior art beach anchor structures and none of the disadvantages.

To attain this, the present invention provides an anchor structure including a unitary housing formed with a planar top surface and a partial planar bottom surface, with an arcuate projection defining a forward portion of the bottom surface for enhanced positioning within a sand surface, wherein the organization includes a tongue member resiliently biased within a through-extending anchor bore directed through a rear portion of the top and bottom surfaces, wtih a forward portion of the bottom surface of the anchor member in biased communication with the top surface to secure a towel portion within the bore under the tongue. A modification of the invention includes bag structure mounted to the top surface for permitting filling of the bag structure with a weighted material, such as beach sand, to enhance tethering of an associated towel member to the beach surface.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved beach towel anchor which has all the advantages of the prior art beach accessory apparatus and none of the disadvantages.

It is another object of the present invention to provide a new and improved beach towel anchor which may be easily and efficiently manufactured and marketed.

It is a further object of the present invention to provide a new and improved beach towel anchor which is of a durable and reliable construction.

An even further object of the present invention is to provide a new and improved beach towel anchor which is susceptible of a low cost of manufacture with regard to both materials and labor, and which accordingly is then susceptible of low prices of sale to the consuming public, thereby making such beach towel anchors economically available to the buying public.

Still yet another object of the present invention is to provide a new and improved beach towel anchor which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
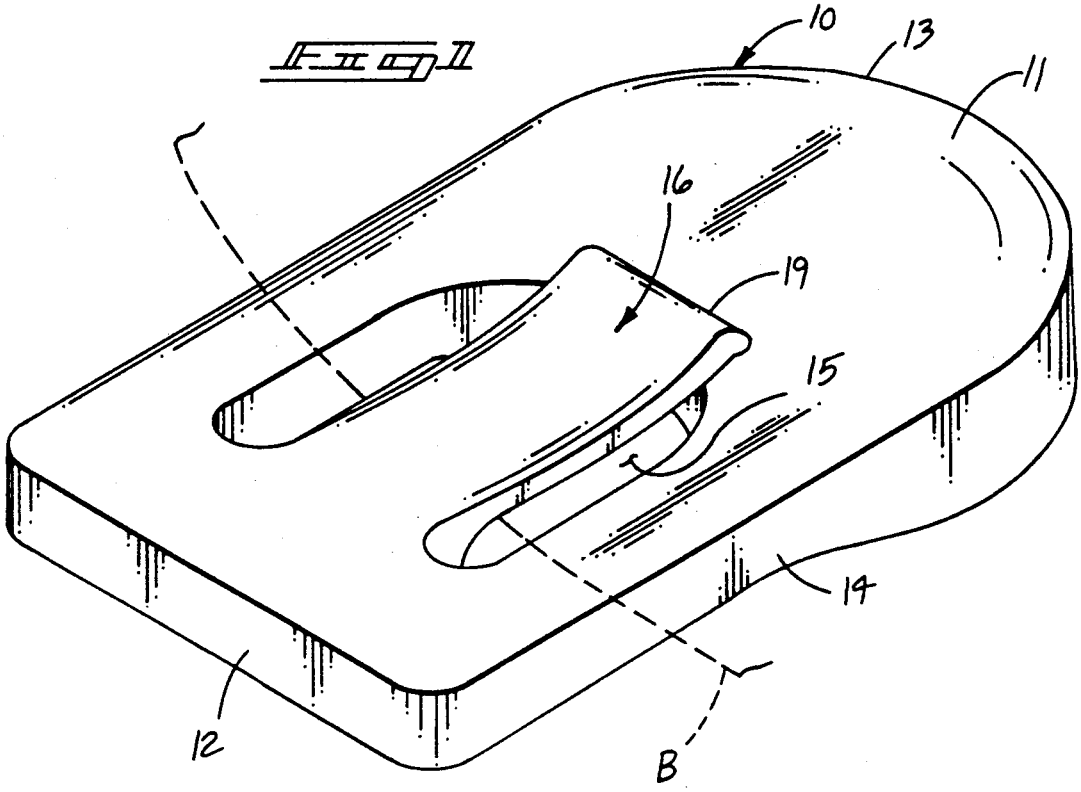
FIG. 1 is an isometric illustration of the instant invention.
Figure 2:
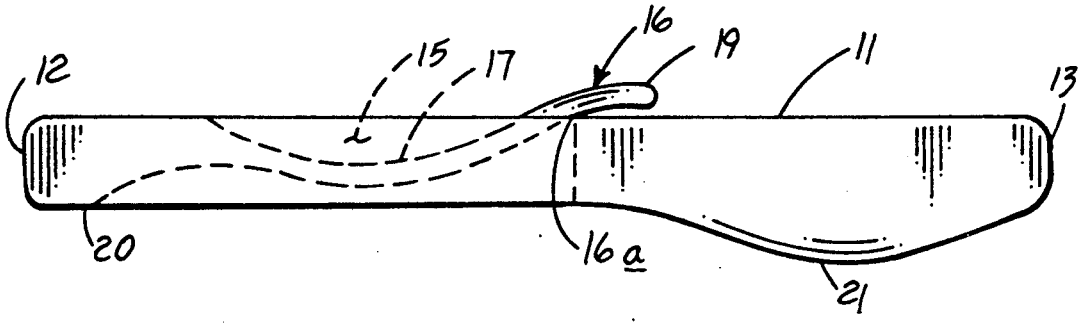
FIG. 2 is an orthographic side view of the invention.
Figure 3:
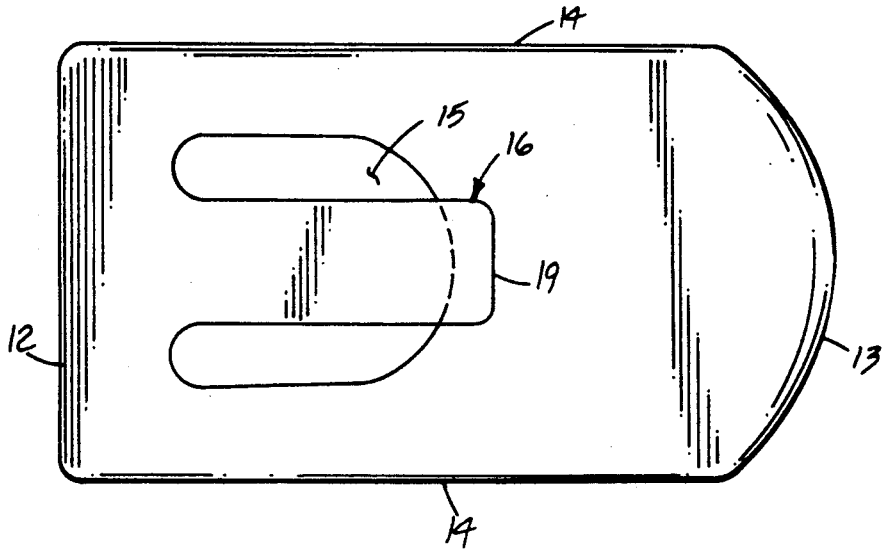
FIG. 3 is an orthographic top view of the invention.

With reference now to the drawings, and in particular to FIGS. 1 to 8 thereof, a new and improved beach towel anchor embodying the principles and concepts of the present invention and generally designated by the reference numeral 10 will be described.

More specifically, the beach towel anchor 10 of the instant invention essentially comprises a unitary block member, including a planar top surface 11, with a planar rear edge surface 12 oriented generally orthogonally relative to the top surface, and a convex forward edge surface 13 oriented orthogonally relative to the top surface, and planar side walls arranged parallel relative to one another and orthogonally relative to the rear surface 12. An anchor bore 15 is through-extending the block member projecting orthogonally downwardly between the planar top surface 11 and a planar rear bottom surface 20. Positioned between the planar rear bottom surface defined between the bore 15 and the forward surface 13 is a convex arcuate forward bottom surface providing additional anchoring weight and providing smooth, curvilinear surface for projection of the device into an associated beach. Anchor bore 15 includes a tongue clip 16 that is fixedly mounted at its rear terminal end to a rear portion of the bore adjacent the rear surface 12. The tongue clip 16 includes a concave arcuate central tongue portion 17 positioned medially within and projecting into the anchor bore 15. The rear tongue end portion 18 is fixedly mounted within the bore 15 adjacent the rear end surface 12. A tongue contact line **16*a* is defined in contact between a bottom surface of the tongue 16 and the top surface 11 at its intersection with the bore 15. The tongue 16 is accordingly biased against the top surface 11 to enhance engagement of a blanket or towel "B" projected between the tongue and the top surface 11**.

Figure 4:
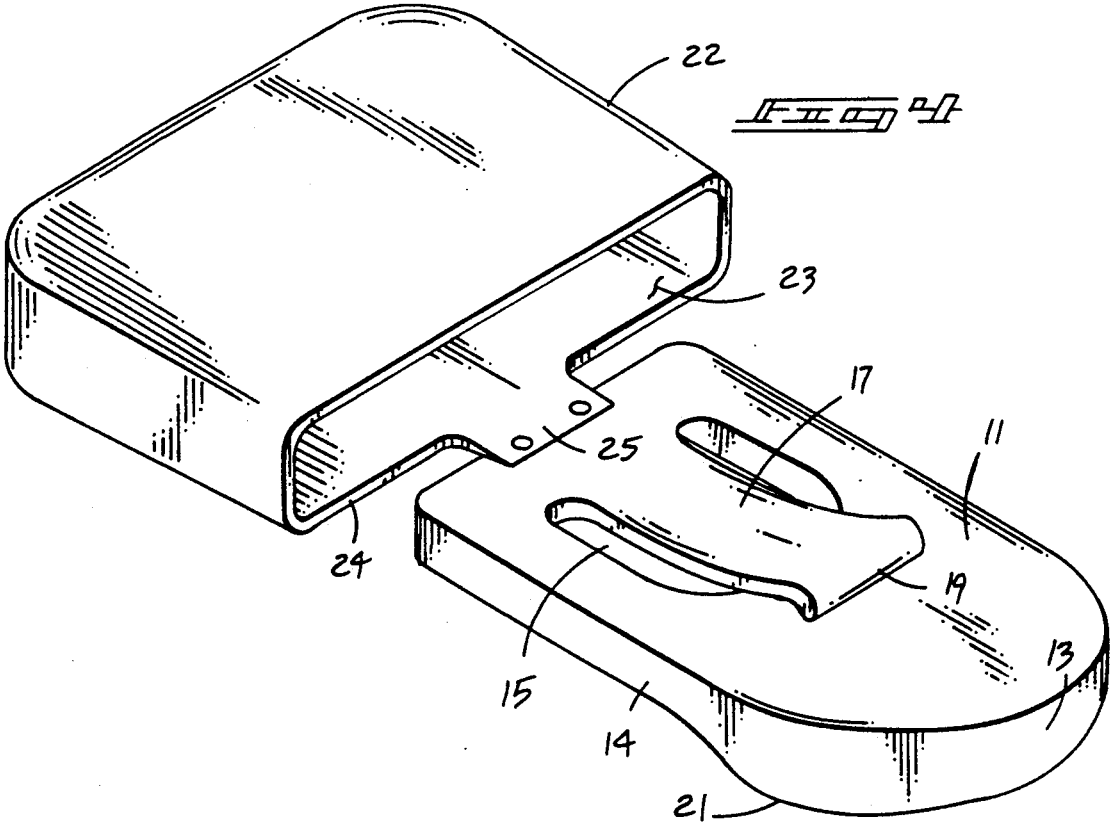
FIG. 4 is an isometric illustration of a modification of the invention.

FIG. 4 illustrates a modified organization utilizing the unitary block member to include a sand pouch 22 that is mounted to the top surface 11 adjacent the rear edge 12. The sand pouch 12 is utilized as an accessory to enhance anchoring and positioning of the anchor structure relative to a top surface of a beach. Typically, the sand pouch 22 permits sand to be directed into the pouch 22 through the pouch opening 23. The opening 23 is defined by a pouch entrance edge 24 in confronting relationship relative to the rear surface 12.

Figure 5:
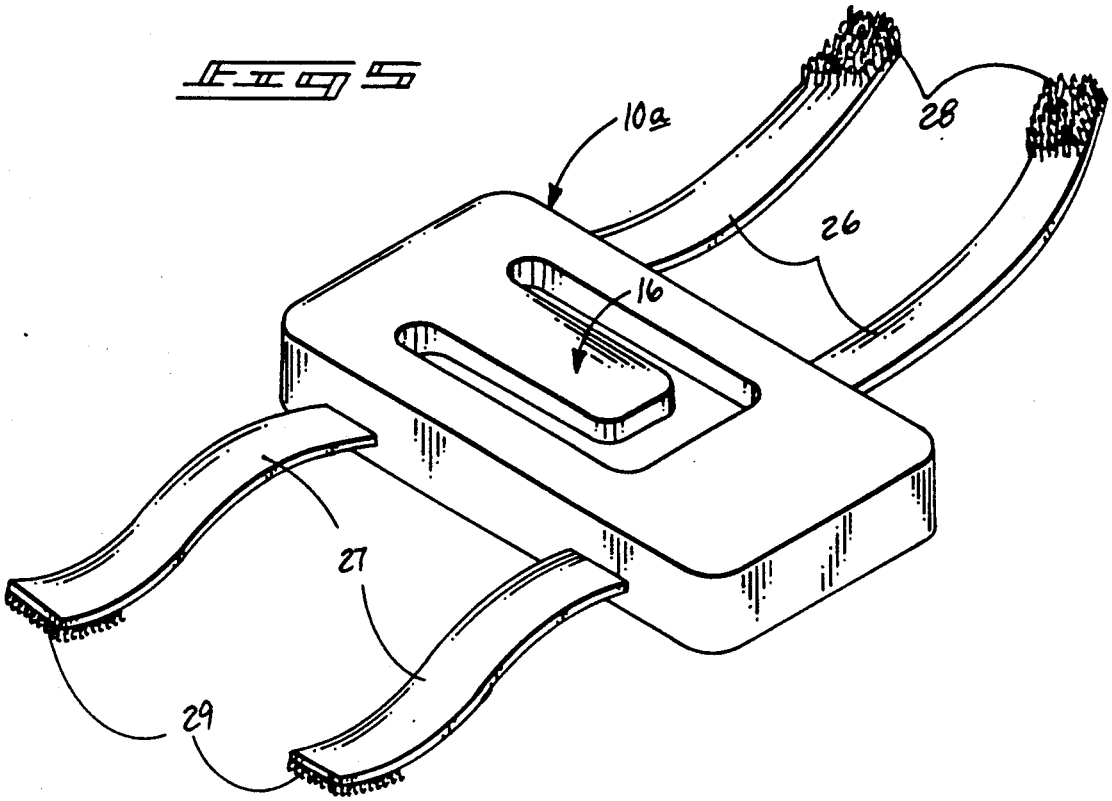
FIG. 5 is an isometric illustration of the invention utilizing strap members.
Figure 6:
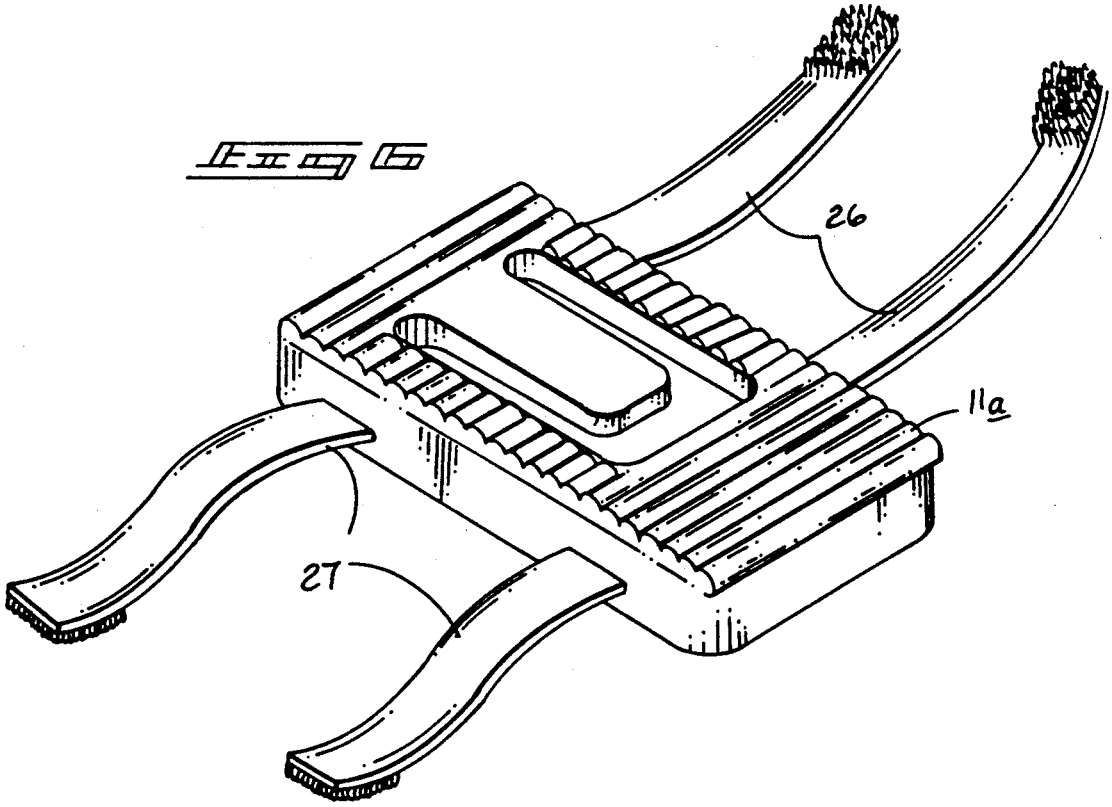
FIG. 6 is an isometric illustration of the invention utilizing a modified top surface.
Figure 7:
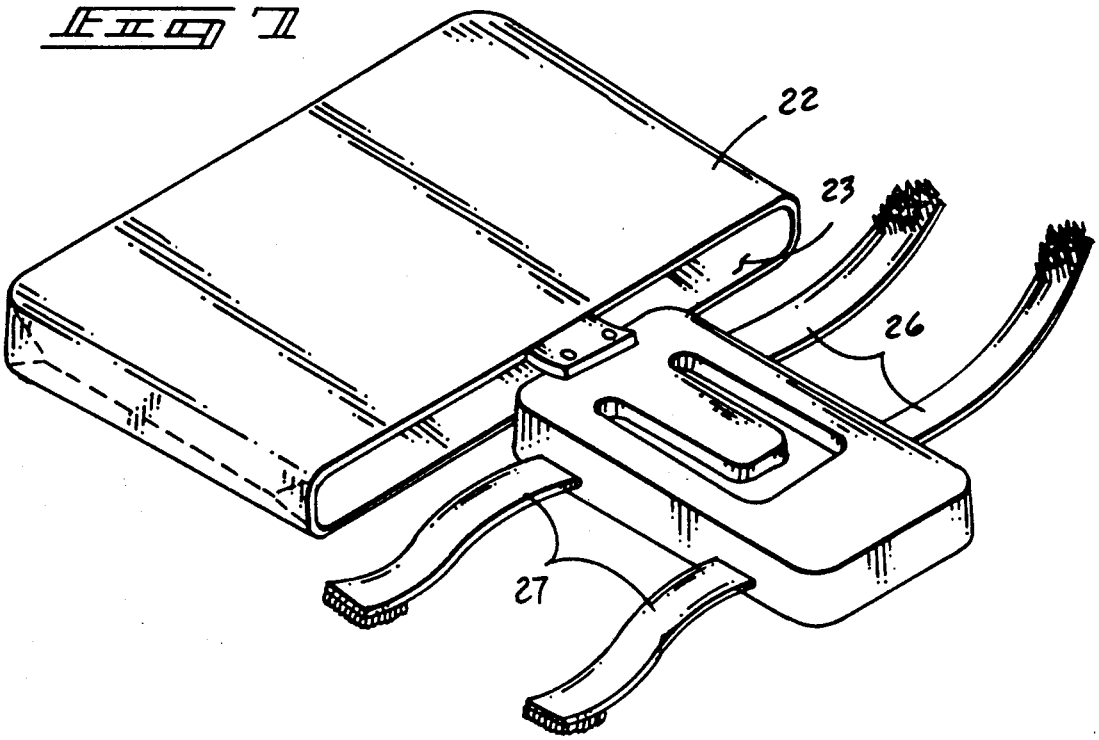
FIG. 7 is an isometric illustration of the invention in combination with strap and the bag structure.
Figure 8:
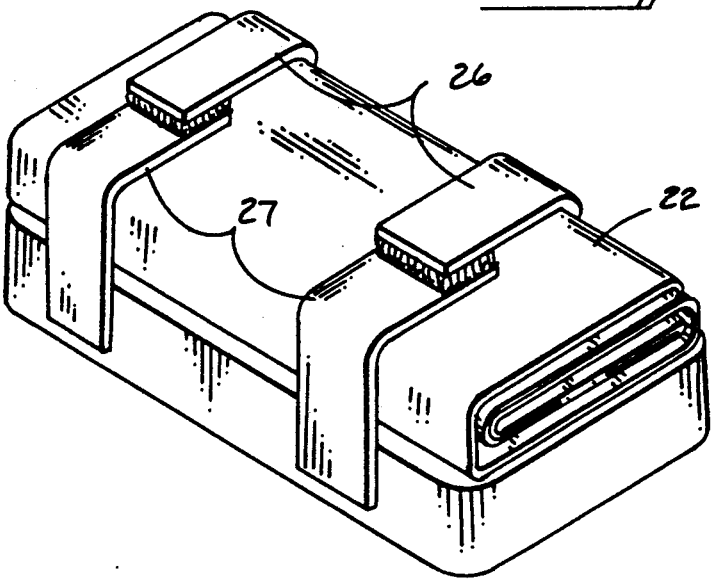
FIG. 8 is an isometric illustration of the invention in an interfolded configuration.

Additionally, the FIGS. 5 and 6 utilize respective first and second straps 26 and 27 that are orthogonally mounted to respective opposed sides of the unitary housing, wherein each of the straps include respective first and second hook and loop fasteners 28 and 29 for inter-engagement. In this manner, the pouch structure defined by the sand pouch 22 is interfolded and positioned onto the top surface 11 of the unitary member, wherein subsequently the straps 26 and 27 are interengaged for securement of the organization into a unitary compact structure.

As to the manner of usage and operation of the instant invention, the same should be apparent from the above disclosure, and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beach towel anchor, comprising in combination, a unitary positioning block, including a planar top surface, and a planar rear edge surface orthogonally oriented relative to the top surface, an arcuate convex forward edge surface, and spaced parallel planar side walls, and a bottom surface, the bottom surface including planar rear bottom surface directed from the rear edge surface to position medially of the bottom surface, and a convex arcuate forward bottom surface directed from the planar rear bottom surface to the arcuate forward surface, and an anchor bore orthogonally directed through the planar top surface and through the planar rear bottom surface, wherein the anchor bore is spaced from the rear surface, and a tongue clip, wherein the tongue clip is mounted within the anchor bore adjacent the rear surface and projects forwardly and longitudinally of the block member over the anchor bore and extending position over the top surface, with a forward tongue end portion positioned over the planar top surface, and wherein the tongue clip includes a concave central portion positioned within the anchor bore, and a tongue contact line defining contiguous communication between a bottom surface of the tongue clip and the top surface, wherein the tongue clip is biased against the tongue contact line, and including a bag pouch mounted rearwardly of the rear surface, the pouch including an entrance opening defined by an entrance edge, wherein the entrance edge is in confronting relationship relative to the rear edge surface and spaced therefrom, and the entrance edge including an edge tongue, the edge tongue mounted to the planar top surface.

2. A towel anchor as set forth in claim 1 including a plurality of first straps mounted to one of said side walls, and a second strap mounted to a further side wall of the plurality of side walls, and the first strap includes first hook and loop fastener portions mounted thereon, and the second strap includes second hook and loop fastener portions mounted thereon, wherein the first and second straps are arranged for securement together, with the pouch interfolded between the first strap, the second strap, and the planar top surface.

* * * * *